US007777114B1

(12) United States Patent
Chen

(10) Patent No.: US 7,777,114 B1
(45) Date of Patent: Aug. 17, 2010

(54) ADJUSTABLE MUSIC PEDAL

(76) Inventor: Kuo-Chang Chen, No. 218, Ln. 39, Sec. 1, Yongxing Rd., Wuqui Chen, Taichung Hsien (TW)

( * ) Notice: Subject to any disclaimer, the term of this patent is extended or adjusted under 35 U.S.C. 154(b) by 0 days.

(21) Appl. No.: 12/554,955

(22) Filed: Sep. 7, 2009

(51) Int. Cl.
*G10D 13/02* (2006.01)

(52) U.S. Cl. ..... 84/422.1

(58) Field of Classification Search ..... 84/422.1, 84/422.2, 422.3

See application file for complete search history.

*Primary Examiner*—Kimberly R Lockett
(74) *Attorney, Agent, or Firm*—Alan Kamrath; Kamrath & Associates PA

(57) ABSTRACT

An adjustable music pedal has a base, a pedal and a linking assembly. The base has a pedal end, a linking end and a longitudinal direction defined from the pedal end to the linking end. The pedal has an adjustment bar and a foot plate. The adjustment bar is connected pivotally to the pedal end of the base and has an adjusting hole formed in the adjustment bar. The foot plate slidably mounted on the adjustment bar, and has a connecting end and a connecting hole. The connecting hole is elongated and formed in the foot plate along the longitudinal direction, and aligns with the adjusting hole. The linking assembly is mounted on the linking end of the base, and has a connector connected to the connecting end of the foot plate of the pedal.

8 Claims, 7 Drawing Sheets

ADJUSTABLE MUSIC PEDAL

BACKGROUND OF THE INVENTION

1. Field of the Invention

The present invention relates to a music pedal, and more particularly to an adjustable music pedal with an adjustment bar and a movable heel mount to adjust the length and the pivoting position of the music pedal.

2. Description of Related Art

With reference to FIG. 7, a conventional music pedal assembly has a base (60), a beater assembly (70) and a pedal. The base (60) is a board and has a beater end and a pedal end.

The beater assembly (70) is mounted on the beater end of the base (60), and has two corresponding stands, a rotating shaft, a stick mount, a chain and a beater stick. The stands are mounted on the beater end of the base (60). The rotating shaft is rotatably mounted between the stands. The stick mount is mounted on the rotating shaft. The chain has a stick mount end and a pedal end. The stick mount end of the chain is connected to the stick mount. The pedal end of the chain extends from the stick mount. The beater stick is connected to and protrudes from the stick mount and has a beater head.

The pedal is connected to the base (60) and the beater assembly, and has a stationary heel (61) and a moving sole (62). The stationary heel (61) is mounted securely on the pedal end of the base (60). The moving sole (62) has a pivoting end and a beater end. The pivoting end of the moving sole (62) is connected pivotally to the stationary heel (61). The beater end of the moving sole (62) is connected to the pedal end of the chain, and is activated to pull the chain and drive the beater stick.

In use, the moving sole (62) is trodden down to pull the chain connected to the stick mount to rotate the stick mount and drive the beater stick to beat a percussion instrument, such as a drum or the like.

However, the conventional music pedal assembly has a fixed pivot at a position where the moving sole (62) is connected to the stationary heel (61). A force length is a fixed length of the moving sole (62) and is unchangeable. Therefore, the conventional music pedal assembly cannot be adjusted to fit different uses for different music genres or musical styles, so is not versatile.

To overcome the shortcomings, the present invention tends to provide an adjustable music pedal to mitigate or obviate the aforementioned problems.

SUMMARY OF THE INVENTION

The main objective of the invention is to provide an adjustable music pedal with an adjustment bar and a movable heel mount to adjust the length and the pivoting position of the music pedal.

The adjustable music pedal has a base, a pedal and a beater assembly. The base has a pedal end, a linking end and a longitudinal direction defined from the pedal end to the linking end. The pedal has an adjustment bar and a foot plate. The adjustment bar is connected pivotally to the pedal end of the base and has an adjusting hole formed in the adjustment bar. The foot plate is slidably mounted on the adjustment bar, and has a connecting end and a connecting hole. The connecting hole is elongated and formed in the foot plate along the longitudinal direction, and aligns with the adjusting hole. The beater assembly is mounted on the linking end of the base, and has a connector connected to the connecting end of the foot plate of the pedal.

Other objects, advantages and novel features of the invention will become more apparent from the following detailed description when taken in conjunction with the accompanying drawings.

DETAILED DESCRIPTION OF PREFERRED EMBODIMENT

Figure 1:
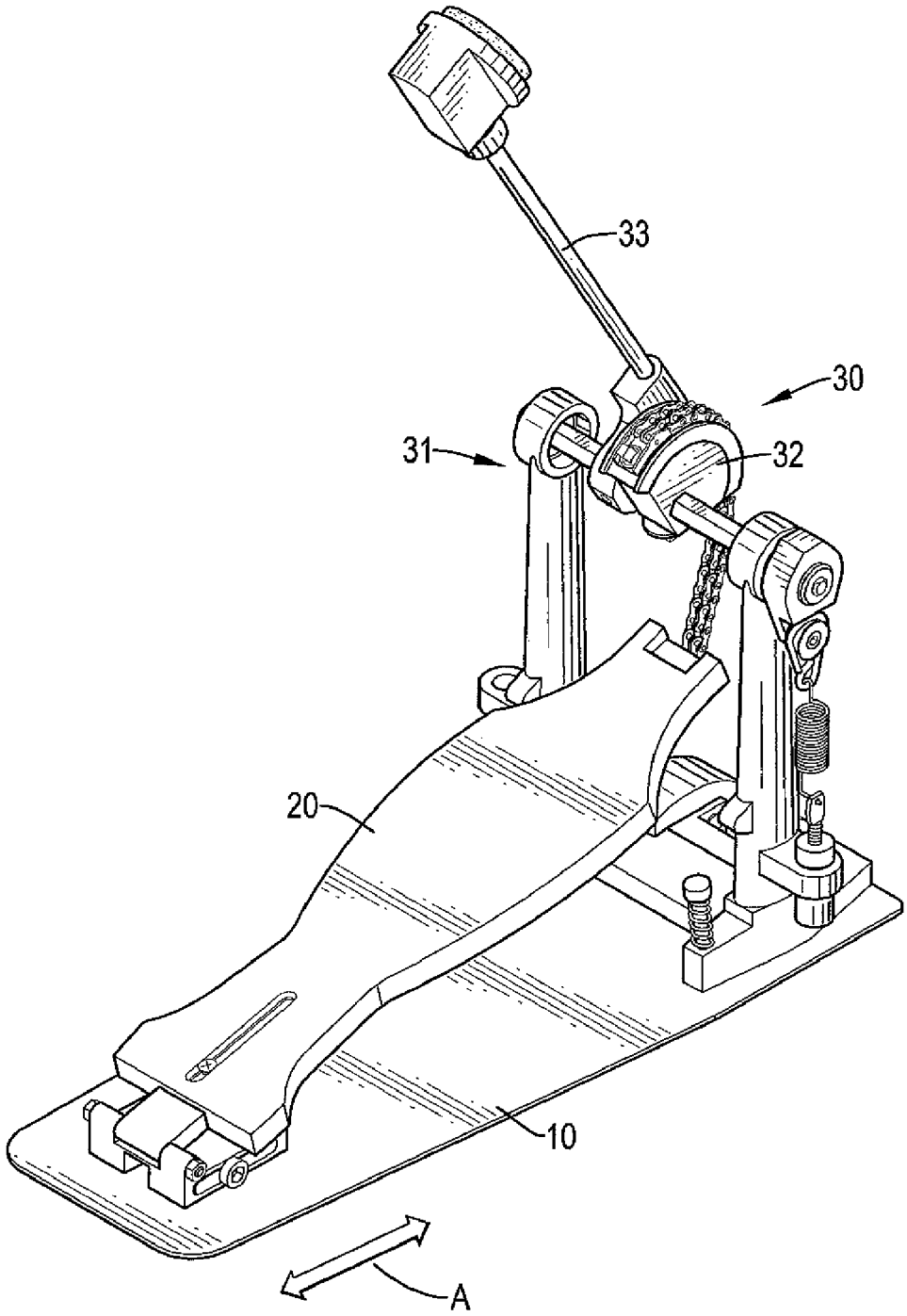
FIG. 1 is a perspective view of an adjustable music pedal using in a drum in accordance with the present invention.
Figure 2:
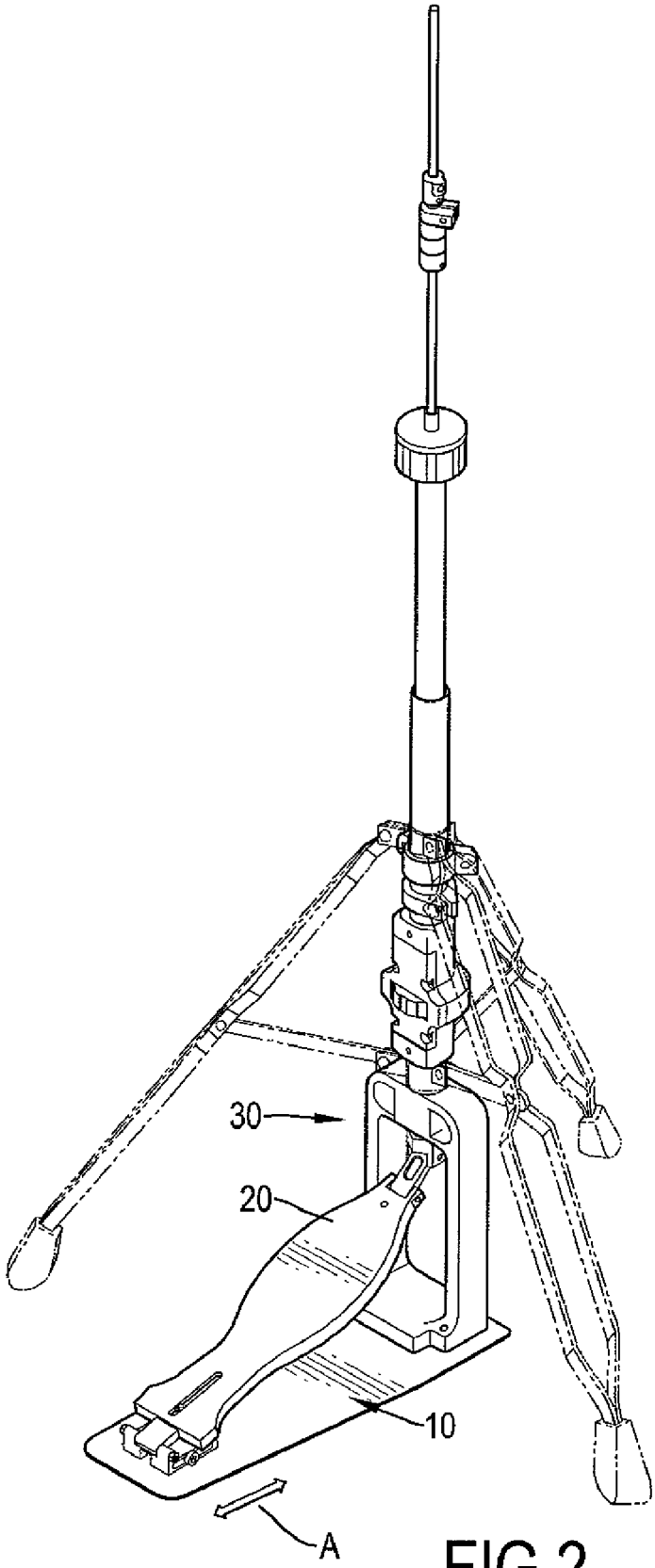
FIG. 2 is a perspective view of the adjustable music pedal using in a hi-hat cymbal in accordance with the present invention.

With reference to FIGS. 1 and 2, an adjustable music pedal in accordance with the present invention is applied to a percussion instrument, such as a drum or a hi-hat cymbal, and has a base (10), a pedal (20) and a linking assembly (30).

Figure 3:
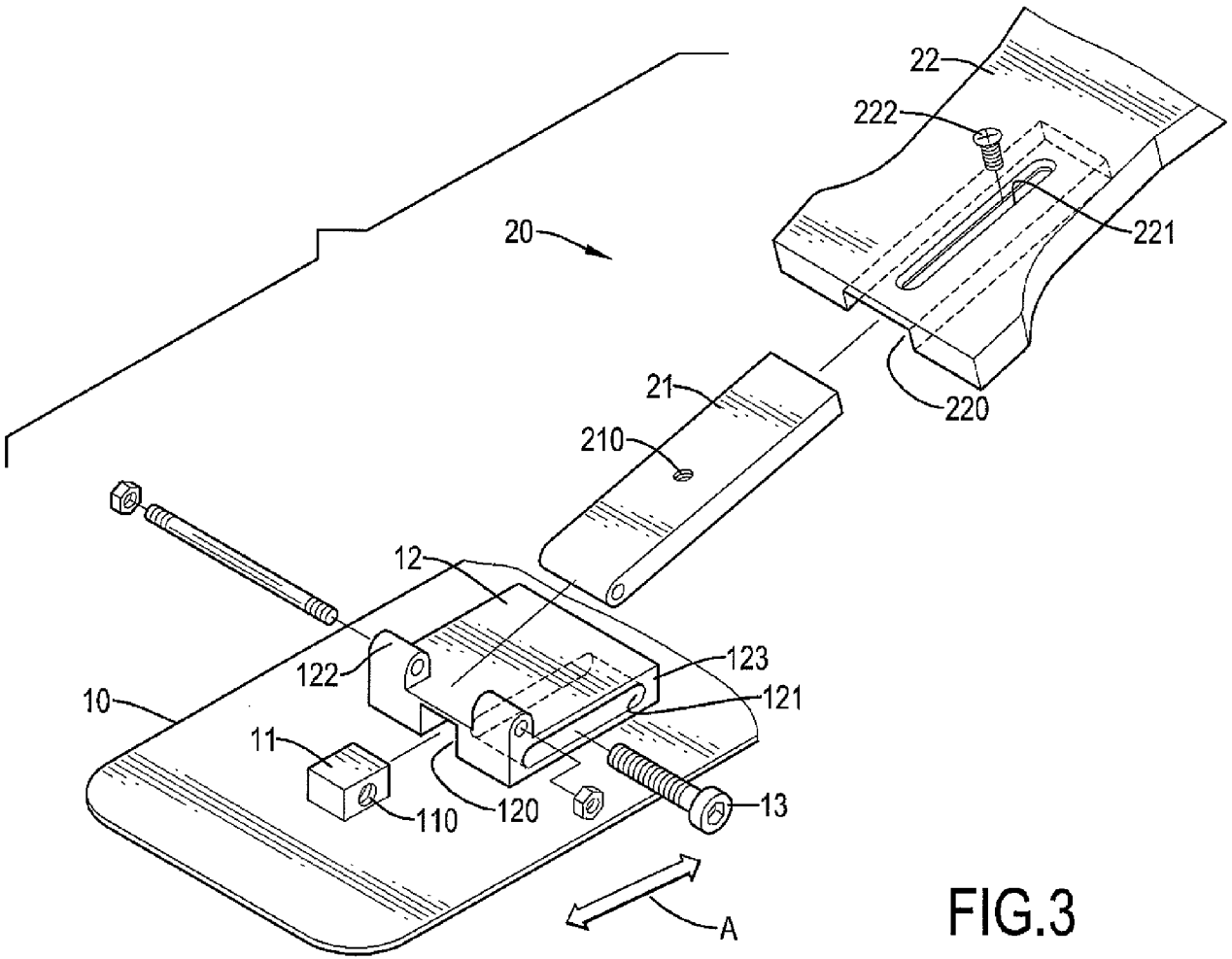
FIG. 3 is an enlarged partially exploded perspective view of the adjustable music pedal in FIG. 1.
Figures 4, 4A:
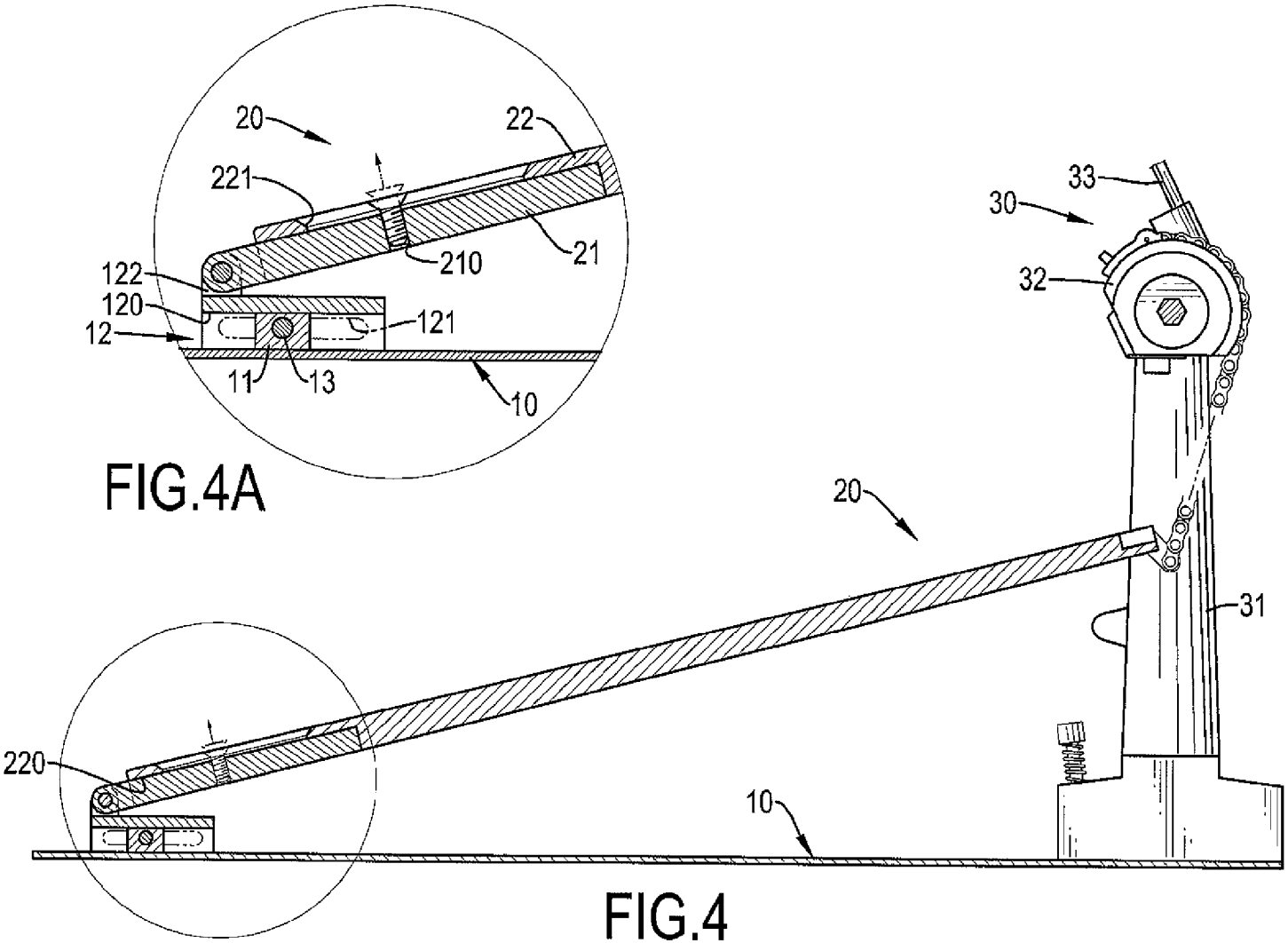
FIG. 4 is a side view in partial section of the adjustable music pedal in FIG. 1.
FIG. 4A is an enlarged side view in partial section of the adjustable music pedal in FIG. 4.

With further reference to FIGS. 3 and 4A, The base (10) is elongated and has a pedal end, a linking end, a longitudinal direction (A), a stationary mount (11), a heel mount (12) and a positioning fastener (13). The longitudinal direction (A) is defined from the pedal end to the linking end of the base (10). The stationary mount (11) is mounted on and protrudes from the pedal end of the base (10), may be rectangular, and has a fixing surface and a fixing hole (110). The fixing surface is defined in parallel with the longitudinal direction (A). The fixing hole (110) is formed in the fixing surface and may be a threaded hole.

The heel mount (12) is slidably mounted on the fixing element (11) along the longitudinal direction (A), may be rectangular, and has a bottom, a guiding recess (120), a pressing surface (123), a positioning hole (121) and a pivoting protrusion (122). The guiding recess (120) is formed in the bottom of the heel mount (12) along the longitudinal direction (A) and is slidably mounted around the stationary mount (11). The pressing surface (123) is defined in the heel mount (12) in parallel with the longitudinal direction (A). The positioning hole (121) is elongated, may be elliptic, is formed in the pressing surface (123), communicates with the guiding recess (120), and aligns with the fixing hole (110).

The positioning fastener (13) is inserted through the positioning hole (121) and mounted in the fixing hole (110) of the stationary mount (11), may be a screw, and has a pressing head abutting securely against the pressing surface (123) to fix the heel mount (12) on the stationary mount (11). The pivoting protrusion (122) is formed on and protrudes from the heel mount (12), and may comprise two protruding blocks respectively protruding from a top of the heel mount (12).

The pedal (20) is connected pivotally to the base (10), and has an adjustment bar (21) and a foot plate (22). The adjustment bar (21) is elongated and connected pivotally to the heel mount (12), and has a pivoting end, an inserting end and an adjusting hole (210). The pivoting end of the adjustment bar (21) is connected pivotally to the pivoting protrusion (122) of the heel mount (12). The inserting end of the adjustment bar (21) extends toward the linking end of the base (10). The adjusting hole (210) is formed in the adjustment bar (21), and may be a threaded hole.

The foot plate (22) is adjustably and slidably mounted on the adjustment bar (21), and has an adjusting end, a connecting end, a top, a bottom, an adjusting recess (220), a connecting hole (221) and a connecting fastener (222). The adjusting end of the foot plate (22) is mounted on the inserting end of the adjustment bar (21). The connecting end of the foot plate (22) is extended toward the linking end of the base (10). The adjusting recess (220) is formed in a bottom of the adjusting end of the foot plate (22) along the longitudinal direction (A), and is slidably mounted around the inserting end of the adjustment bar (21). The connecting hole (221) is elongated and formed in the adjusting end of the foot plate (22) along the longitudinal direction (A), communicates with the adjusting recess (220), and may align with the adjusting hole (210). The connecting fastener (222) is inserted through the connecting hole (221) of the foot plate (22), and is mounted in the adjusting hole (210) in the adjustment bar (21) to connect the adjustment bar (21) with the foot plate (22). The connecting fastener (222) has a head abutting the top of the foot plate (22).

The linking assembly (30) is mounted on the linking end of the base (10), and may be a drum beater or a hi-hat beater and may has two corresponding stands (31), a rotating shaft, a connector (32) and a beater stick (33). The stands (31) are mounted on the linking end of the base (10). The rotating shaft is rotatably mounted between the stands (31). The connector (32) is mounted on the shaft of the stand (31), connected to the pedal (20), and may have a chain connected to the connecting end of the foot plate (22) of the pedal (20). The beater stick (33) is mounted on the connector (32), and driven to beat a percussion instrument, such as a drum.

With reference to FIGS. 4 and 4A, to adjust the pedal length of the adjustable music pedal, the connecting fastener (222) is first released, then the foot plate (22) of the pedal (20) is pulled toward the linking end or the pedal end of the base (10) along the longitudinal direction (A). The connecting fastener (222) is then mounted through the connecting hole (221) and mounted in the adjusting hole (210) to connect the foot plate (22) and the adjustment bar (21), such that the length of the pedal (20) can be adjusted based on needs of users.

Figures 5, 5A:
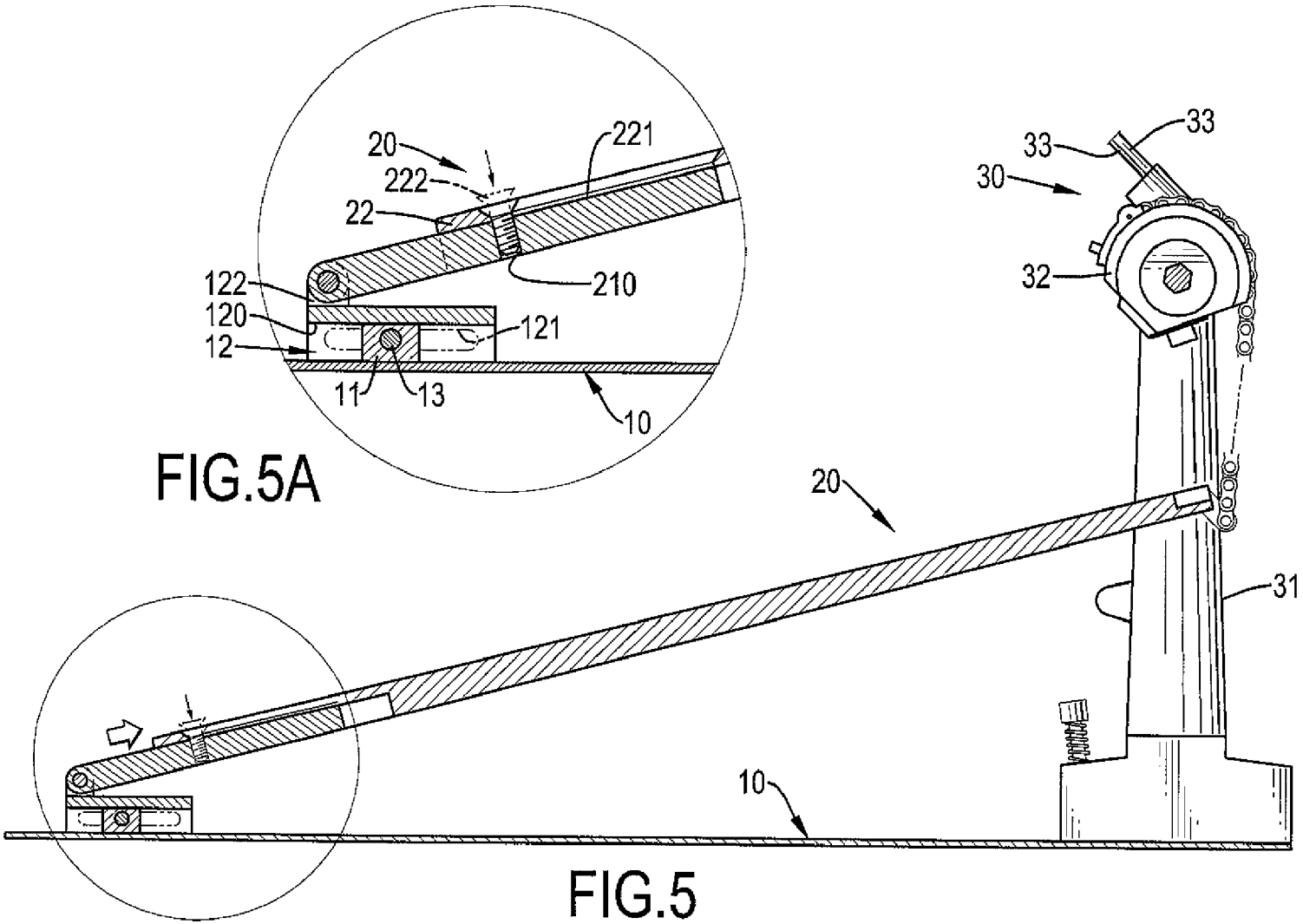
FIG. 5 is an operational side view in partial section of the pedal of the adjustable music pedal in FIG. 4.
FIG. 5A is an enlarged operational side view in partial section of the pedal of the adjustable music pedal in FIG. 5.
Figure 6:
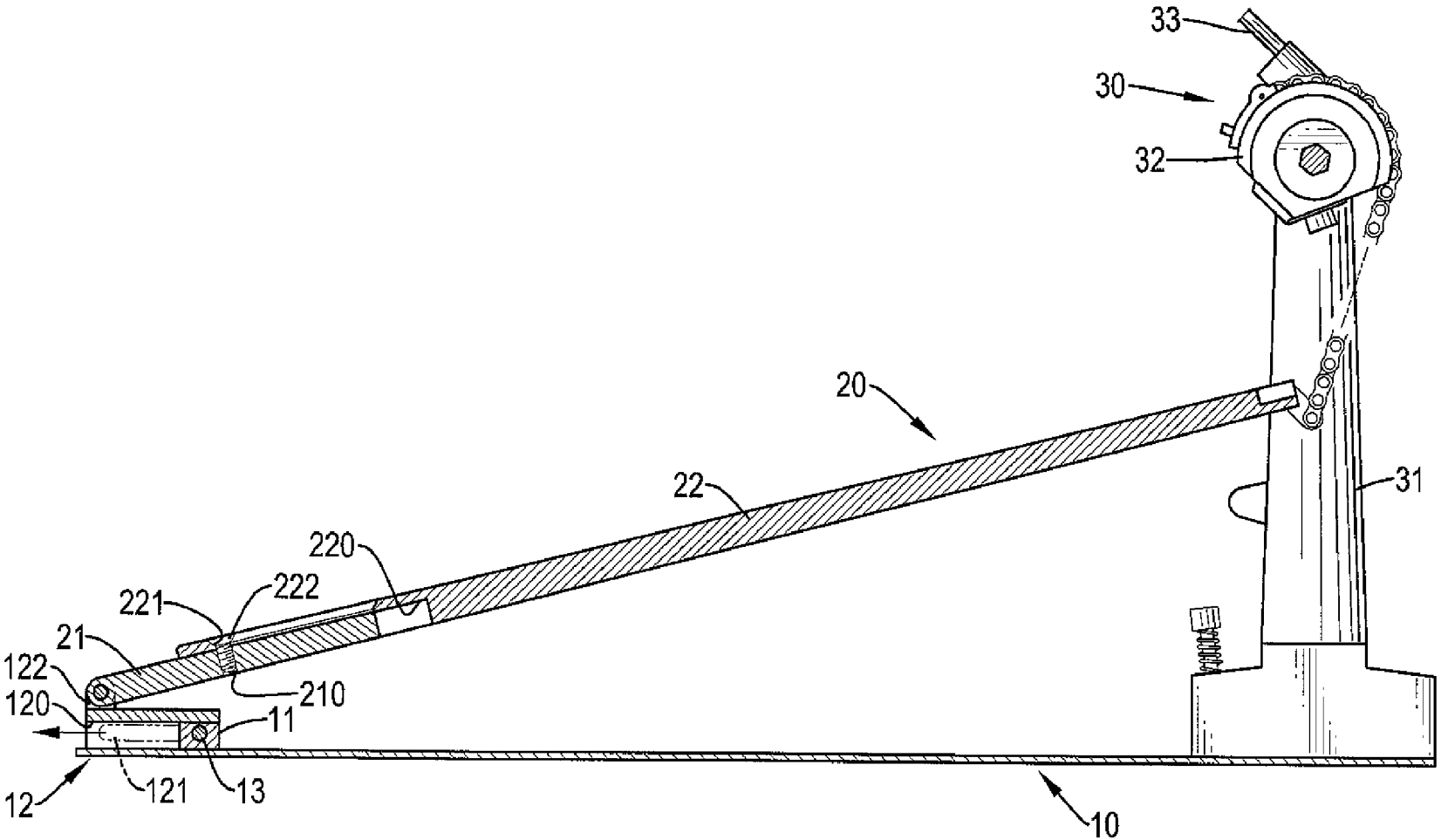
FIG. 6 is an operational side view in partial section of the heel mount of the adjustable music pedal in FIG. 5.
Figure 7:
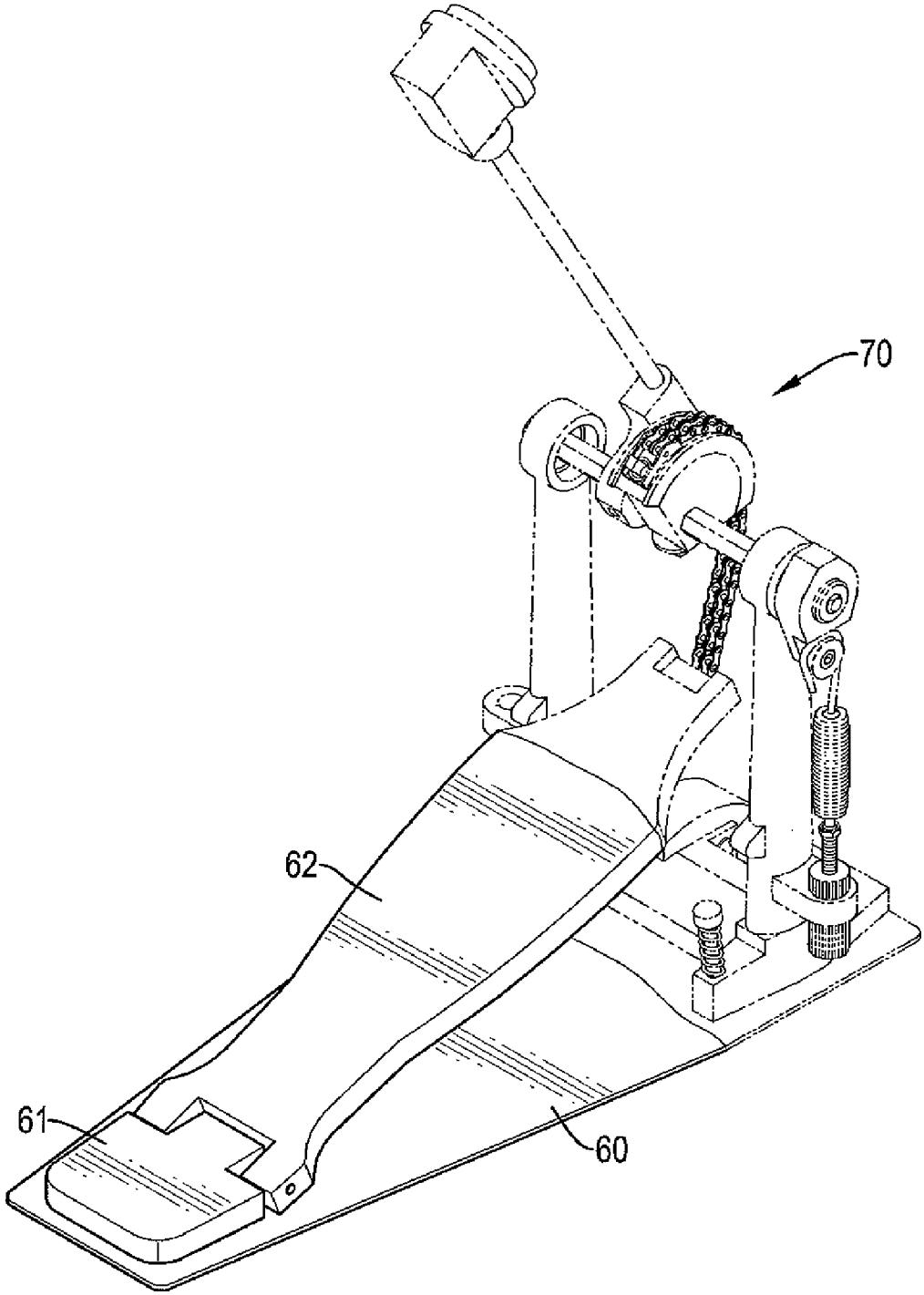
FIG.7 PRIOR ART
FIG. 7 is a perspective view of a conventional music pedal in accordance with the prior art.

With reference to FIGS. 5 to 6, when the pressing head of the positioning fastener (13) is released from the pressing surface (123) of the heel mount (12), the heel mount (12) can be slid toward the linking end or the pedal end of the base (10) along the longitudinal direction (A). The pivoting position of the pedal (20) is adjusted and moved to conform to needs of users.

Because the positioning hole (121) is elongated, and the positioning fastener (13) may abut the pressing surface (123) of the heel mount (12) anywhere in the positioning hole (121), the positioning hole (121) provides a stepless adjusting effect to hold the heel mount (12) at a desired position relative to the stationary mount (11). The positioning fastener (13) is screwed and mounted in the fixing hole (110), and the pressing head of the positioning fastener (13) abuts the pressing surface (123) of the heel mount (12) to hold the heel mount (12) at a position relative to the stationary mount (11).

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An adjustable music pedal comprising:

a base having a pedal end;

a linking end; and a longitudinal direction defined from the pedal end to the linking end of the base;

a pedal having an adjustment bar having a pivoting end connected pivotally to the pedal end of the base;

an inserting end extending toward the linking end of the base; and an adjusting hole formed in the adjustment bar; and a foot plate slidably mounted on the adjustment bar along a longitudinal direction, and having an adjusting end mounted on the inserting end of the adjustment bar;

a connecting end extending toward the linking end of the base;

a connecting hole being elongated and formed in the adjusting end of the foot plate along the longitudinal direction, and aligning with the adjusting hole; and a connecting fastener inserted through the connecting hole of the foot plate, and mounted in the adjusting hole of the adjustment bar to connect the adjustment bar with the foot plate; and a linking assembly mounted on the linking end of the base, and having a connector connected to the connecting end of the foot plate of the pedal.

2. The adjusting music pedal as claimed in claim 1, wherein the base further has a stationary mount protruding from the pedal end of the base;

a heel mount slidably mounted on the fixing element along the longitudinal direction, and connected pivotally to the pivoting end of the adjustment bar, and having a positioning hole being elongated and formed in the heel mount; and a positioning fastener inserted through the positioning hole, mounted in the stationary mount, and having a pressing head extending out the positioning hole and abutting securely against the heel mount.

3. The adjusting music pedal as claimed in claim 2, wherein the stationary mount further has a fixing surface defined in parallel with the longitudinal direction;

a fixing hole formed in the fixing surface; and the heel mount has a bottom;

a guiding recess formed in the bottom of the heel mount along the longitudinal direction and slidably mounted around the stationary mount; and a pressing surface defined in parallel with the longitudinal direction;

the positioning hole is formed in the pressing surface, and communicates with the guiding recess, and aligns with the fixing hole;

the positioning fastener is inserted through the positioning hole of the heel mount, and is mounted in the fixing hole of the stationary mount.

4. The adjusting music pedal as claimed in claim 1, wherein the heel mount further has a pivoting protrusion; and the pivoting end of the adjustment bar connected pivotally to the pivoting protrusion of the heel mount.

5. The adjusting music pedal as claimed in claim 2, wherein the heel mount further has a pivoting protrusion; and the pivoting end of the adjustment bar connected pivotally to the pivoting protrusion of the heel mount.

6. The adjusting music pedal as claimed in claim 3, wherein the heel mount further has a pivoting protrusion; and the pivoting end of the adjustment bar connected pivotally to the pivoting protrusion of the heel mount.

7. The adjusting music pedal as claimed in claim 3, wherein the fixing hole is a threaded hole; and the positioning fastener is a screw.

8. The adjusting music pedal as claimed in claim 6, wherein the fixing hole is a threaded hole; and the positioning fastener is a screw.

* * * * *